US008083055B2

(12) United States Patent
Simonian et al.

(10) Patent No.: US 8,083,055 B2
(45) Date of Patent: Dec. 27, 2011

(54) DISPENSING CAP SYSTEM FOR BEVERAGE BOTTLES

(75) Inventors: Christopher H. Y. Simonian, Sherman Oaks, CA (US); Jeannine Simonian, Sherman Oaks, CA (US); Ian J. Fettes, June Lake, CA (US)

(73) Assignee: Tap the Cap, Inc., Sherman Oaks, CA (US)

( * ) Notice: Subject to any disclaimer, the term of this patent is extended or adjusted under 35 U.S.C. 154(b) by 105 days.

(21) Appl. No.: 12/789,861

(22) Filed: May 28, 2010

(65) Prior Publication Data

US 2011/0290677 A1 Dec. 1, 2011

(51) Int. Cl.
*B65D 25/08* (2006.01)

(52) U.S. Cl. ..... 206/221; 215/227; 215/DIG. 8; 222/145.5; 222/525

(58) Field of Classification Search ..... 206/219–222, 206/568; 215/6, 10, 227, DIG. 8; 222/145.1–145.6, 222/129, 325, 525, 544, 566
See application file for complete search history.

(56) References Cited

U.S. PATENT DOCUMENTS

| | | | | | |
|---|---|---|---|---|---|
| 2,793,776 | A | | 5/1957 | Lipari | |
| 2,807,384 | A | | 9/1957 | Lipari | |
| 2,813,649 | A | | 11/1957 | Lipari | |
| 3,019,932 | A | | 2/1962 | Singiser | |
| 3,156,369 | A | | 11/1964 | Bowes et al. | |
| 3,840,136 | A | | 10/1974 | Lanfranconi et al. | |
| 3,924,741 | A | * | 12/1975 | Kachur et al. | 206/221 |
| 4,195,730 | A | | 4/1980 | Hunt | |
| 4,221,291 | A | | 9/1980 | Hunt | |
| 4,712,715 | A | * | 12/1987 | Fischer | 222/145.5 |
| 4,727,985 | A | | 3/1988 | McNeirney et al. | |
| 4,793,475 | A | | 12/1988 | Itzel | |
| 4,865,189 | A | * | 9/1989 | Guerra et al. | 206/221 |
| 4,911,316 | A | | 3/1990 | Tackles | |
| 5,029,049 | A | | 7/1991 | Ladyjensky | |
| 5,060,791 | A | * | 10/1991 | Zulauf | 206/221 |
| 5,419,445 | A | | 5/1995 | Kaesemeyer | |
| 5,678,720 | A | | 10/1997 | Van Melle | |
| 5,927,549 | A | | 7/1999 | Wood | |
| 5,971,140 | A | | 10/1999 | Frutin | |
| 6,113,257 | A | | 9/2000 | Sharon et al. | |
| 6,138,821 | A | | 10/2000 | Hsu | |
| 6,152,296 | A | | 11/2000 | Shih | |
| 6,257,428 | B1 | | 7/2001 | Caola | |
| 6,372,270 | B1 | | 4/2002 | Denny | |
| 6,513,650 | B2 | | 2/2003 | Mollstam et al. | |

(Continued)

FOREIGN PATENT DOCUMENTS

| | | | |
|---|---|---|---|
| JP | 2002211622 | A | 7/2002 |

(Continued)

*Primary Examiner* — Luan K Bui
(74) *Attorney, Agent, or Firm* — Law Offices of David L. Hoffman

(57) ABSTRACT

A dispensing cap system for dispensing a supplement material through a bottle neck opening and into the bottle. An exemplary embodiment includes a cap member configured for connection to beverage bottle necks of different sizes. A seal member is arranged to provide a liquid seal against the neck opening. A valve member passes through a storage member attached to the cap member, and is configured for movement between a storage position and a dispensing position, in which passage is permitted of the supplement material from the storage member into the bottle. A nipple member may be positioned over the valve member to allow the bottle contents to be utilized or consumed.

24 Claims, 12 Drawing Sheets

U.S. PATENT DOCUMENTS

| | | | | |
|---|---|---|---|---|
| 6,527,110 | B2 | 3/2003 | Moscovitz | |
| 6,533,113 | B2 | 3/2003 | Moscovitz | |
| 6,540,070 | B1 | 4/2003 | Conwell | |
| 6,609,612 | B2 | 8/2003 | Vlodek | |
| 6,702,161 | B2 | 3/2004 | Adams et al. | |
| 6,705,462 | B2 | 3/2004 | Kasuya | |
| 6,766,903 | B1 | 7/2004 | Yehhsu | |
| 6,786,330 | B2 | 9/2004 | Mollstam et al. | |
| 6,820,740 | B1 | 11/2004 | Spector | |
| 6,854,595 | B2 | 2/2005 | Kiser | |
| 6,921,087 | B2 | 7/2005 | Takahashi et al. | |
| 6,926,138 | B1 | 8/2005 | Basham et al. | |
| 6,935,493 | B2 | 8/2005 | Cho | |
| 6,959,841 | B2 | 11/2005 | Vlodek | |
| 6,962,254 | B2 | 11/2005 | Spector | |
| 6,974,024 | B2 | 12/2005 | Cho | |
| 6,994,211 | B2 | 2/2006 | Cho | |
| 7,070,046 | B2 | 7/2006 | Cho | |
| 7,172,095 | B2 * | 2/2007 | Marshall | 206/219 |
| 7,178,683 | B2 | 2/2007 | Birkmayer et al. | |
| 7,210,575 | B2 | 5/2007 | Oswald | |
| 7,347,322 | B2 | 3/2008 | Cho | |
| 7,484,633 | B1 | 2/2009 | Moher | |
| 7,503,453 | B2 * | 3/2009 | Cronin et al. | 206/221 |
| 7,546,919 | B2 | 6/2009 | Lee | |
| 7,562,782 | B2 | 7/2009 | Yorita | |
| 7,588,142 | B1 | 9/2009 | Bush | |
| 7,607,549 | B2 | 10/2009 | Morini | |
| 7,854,104 | B2 * | 12/2010 | Cronin et al. | 206/219 |
| 2001/0035387 | A1 | 11/2001 | Sutcliffe-Noyd | |
| 2004/0154937 | A1 | 8/2004 | Cho | |
| 2005/0184024 | A1 | 8/2005 | Santa Cruz et al. | |
| 2005/0218015 | A1 | 10/2005 | Spector | |
| 2006/0283726 | A1 * | 12/2006 | McCloud | 206/219 |
| 2007/0023300 | A1 | 2/2007 | Spector et al. | |
| 2007/0215496 | A1 | 9/2007 | Scarborough | |
| 2008/0093326 | A1 | 4/2008 | Cho | |
| 2008/0116086 | A1 | 5/2008 | Hung | |
| 2008/0202950 | A1 | 8/2008 | Anderson | |
| 2008/0223485 | A1 | 9/2008 | Nyambi et al. | |
| 2008/0223740 | A1 | 9/2008 | Ramsey et al. | |
| 2008/0223741 | A1 | 9/2008 | Nyambi et al. | |
| 2008/0289976 | A1 | 11/2008 | Henry | |
| 2009/0236303 | A1 | 9/2009 | Lizerbram et al. | |
| 2009/0260690 | A1 | 10/2009 | Bell | |
| 2009/0308831 | A1 | 12/2009 | Anderson | |

FOREIGN PATENT DOCUMENTS

| | | | |
|---|---|---|---|
| JP | 2006124008 | A | 5/2006 |
| JP | 2006124009 | A | 5/2006 |
| JP | 2006131283 | A | 5/2006 |

* cited by examiner

DISPENSING CAP SYSTEM FOR BEVERAGE BOTTLES

BACKGROUND

Addition of powdered supplements to a beverage container is becoming increasingly popular. For example, powdered supplements may be stored in an assembly which is fitted to the neck of the container, to release the supplement into a container of water, to be consumed by the user. The assemblies can be expensive to manufacture, and typically are designed to fit a specific container size.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1A:
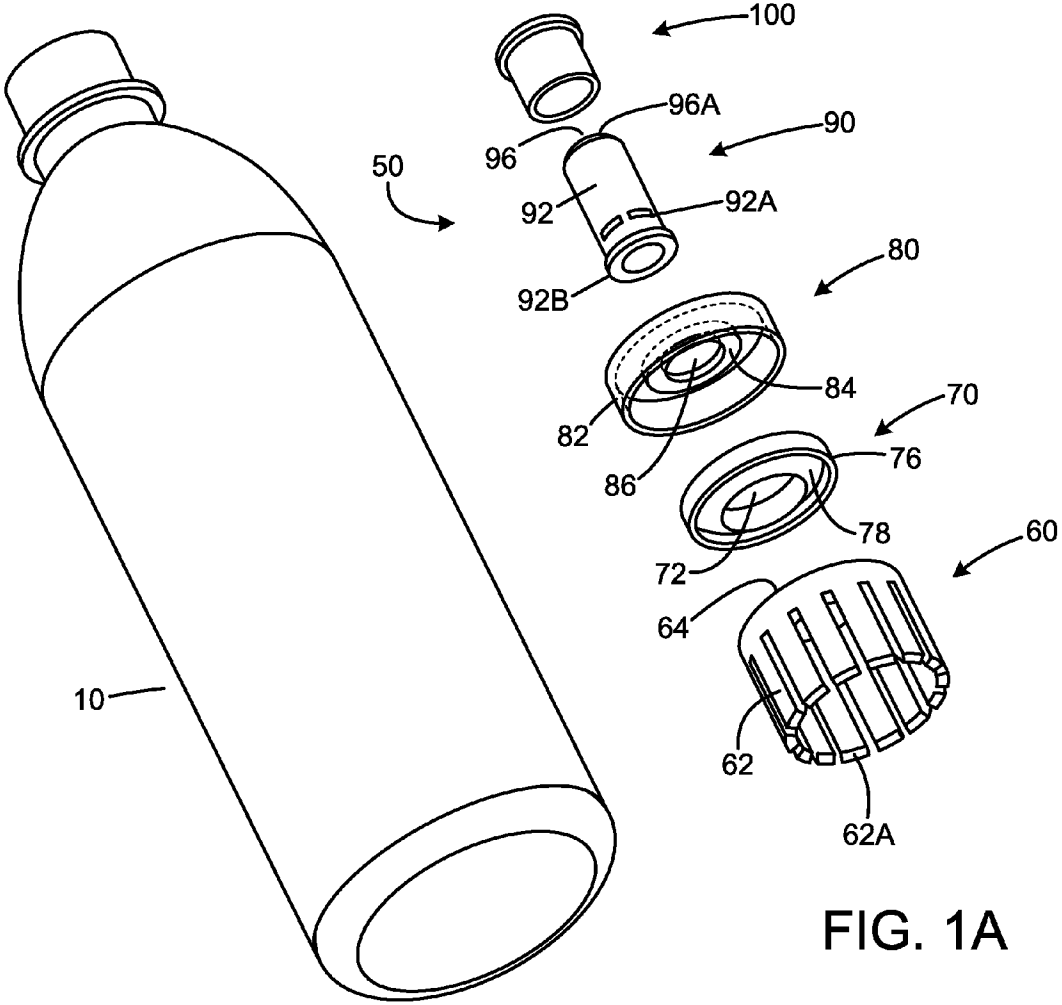
FIGS. 1A-1C are exploded views of an exemplary embodiment of a bottle cap dispensing system.

In the following detailed description and in the several figures of the drawing, like elements are identified with like reference numerals.

One exemplary embodiment is directed to a bottle cap assembly, configured to fit beverage bottles of different neck dimensions, and to dispense a liquid or solid additive such as a nutritional supplement into the bottle contents. For example, the bottle cap assembly may be configured to fit onto both an Evian™ water bottle of a relatively larger neck size and an Arrowhead™ water bottle with a somewhat smaller neck size. In another embodiment, the bottle cap assembly is configured to fit onto at least three water bottles of different sizes. These exemplary embodiments includes a valve which the user pushes or pulls to release a supplement in powdered or liquid form into the bottle contents, and also remains in place for the user to drink through. The valve also closes and opens to allow the user to seal the bottle or drink from the bottle. Once the bottle contents have been consumed, the bottle cap is typically not re-used, in an exemplary embodiment.

Figure 1B:
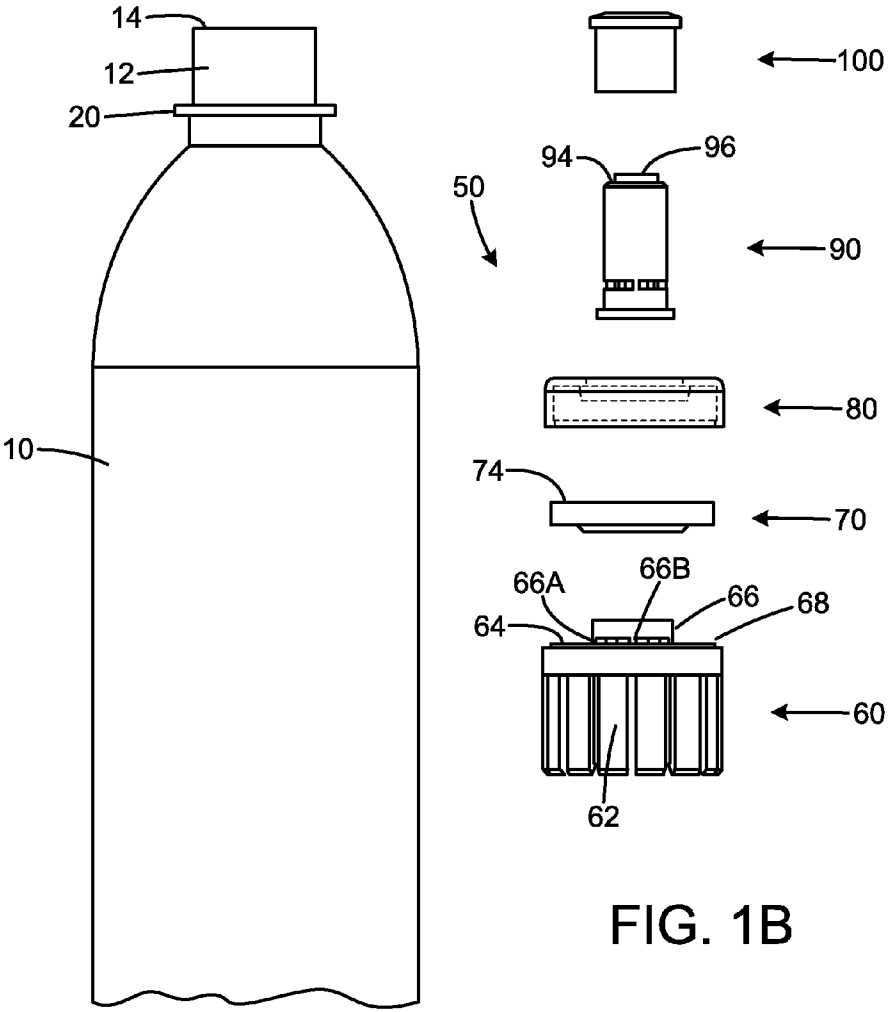
Figure 1C:
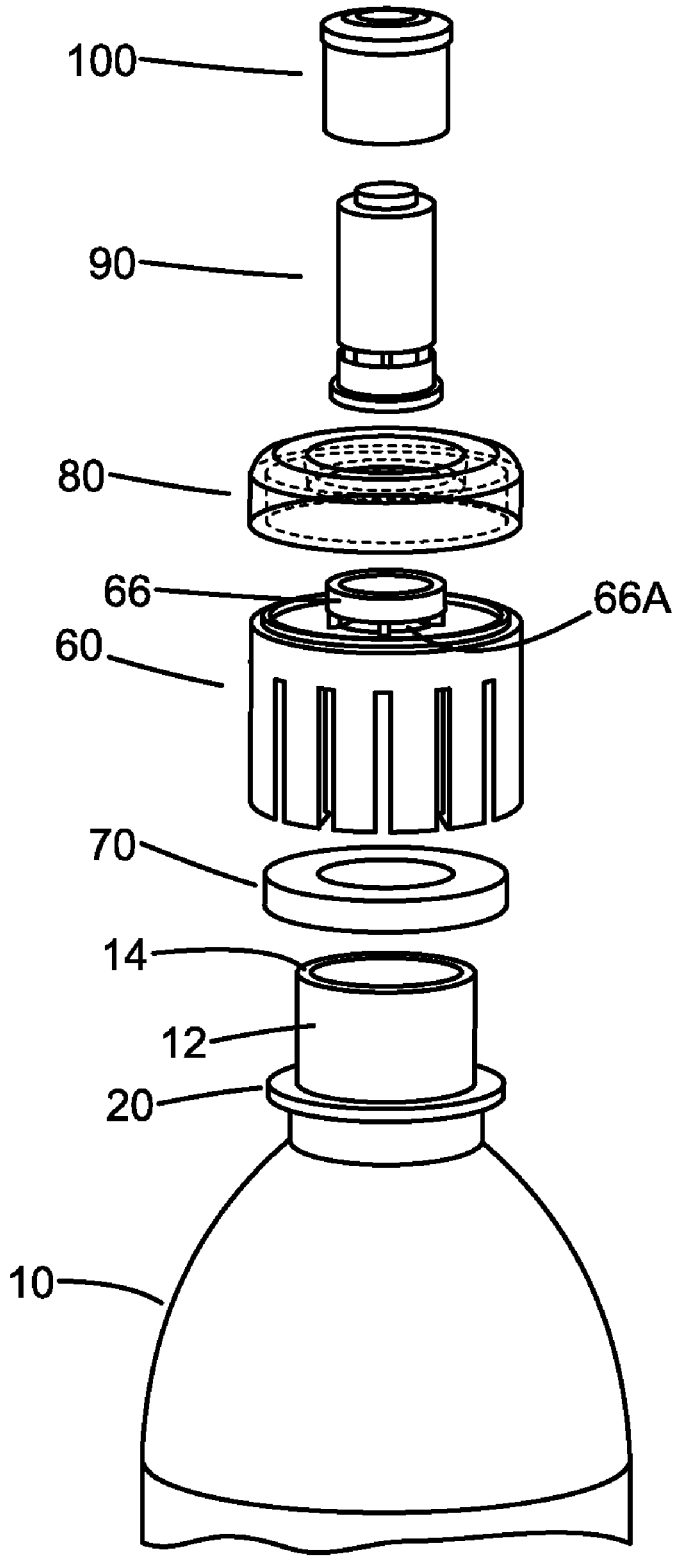

FIGS. 1A-1C are exploded views of an exemplary embodiment of a dispensing cap system 50. The cap system is configured to seal to the mouth of a beverage bottle 10. In a typical embodiment, the bottle neck may have threads to allow a conventional threaded bottle cap or bottle cap and valve to be threadingly attached to the bottle. The cap system 50 in such a case would be attached to the bottle neck after the convention bottle cap has been removed. For simplicity, the threads on the bottle neck, above the neck flange, are not shown in the figures. The cap system 50 includes a cap member 60 of a generally having a plurality of finger portions 62 projecting from a web portion 64. The distal ends of the finger portions terminate in inwardly projecting barb or tab portions 62A, which may have sloped surfaces. The web portion has a hollow upwardly projecting boss portion 66, i.e. projecting above the web portion away from the finger portions. The boss portion 66 has a plurality of spaced dispensing openings 66A formed adjacent the web surface between ribs 66B, and these openings will allow the supplement material to pass through, as described more fully below.

The cap member 60 may be fabricated of a plastic material such as styrene, ABS, Delrin™ or Nylon™, and the finger portions are thin and have some flexibility. The cap member and the length of the finger portions is sized so that the tips of the finger portions may flex outwardly as the cap member is pushed onto the neck 12 of the bottle, and the barb portions engage under the flange 20 extending from the bottle neck. The cap member further includes a circumferential vertical rib 68 extending upwardly from the web portion 64, of a smaller diameter than the diameter of the web portion, to provide an attach feature for attaching structure 80, describe below. In this embodiment, the cap member 60 includes a connection structure for non-threading connection of the cap system to a beverage bottle, by engagement with the bottle flange or collar. In this embodiment, the connection structure includes the finger portions and the barb portions. This type of connection structure does not have to match the threads of the bottle neck, which may vary with different beverage vendors and/or bottle types. The number of finger portions may vary in other embodiments. For example, the fewer and relatively more rigid finger portions may be used. In other embodiments, the connection structure may include finger portions with teeth which engage the threads on bottle neck by sliding over some or all the threads as the cap system is pushed onto the bottle neck, and locking in place without rotationally being threaded onto the threads of the bottle.

The cap system also includes a seal member 70, shown for clarity in FIGS. 1A-1B above the cap member 60, but actually sized to fit within the barrel of the cap member. The seal member is preferably fabricated of an elastomeric material, such as, by way of example only, thermoplastic rubber (TPR) (molded rubber) or closed cell foam, and has a center opening configured for concentricity with the opening through the boss. Other features of the seal member will be discussed below.

A supplement storage member 80 is configured for attachment to web portion of the cap member, and, as will be described more fully below, defines the outer periphery of a storage volume for a quantity of a supplement in granular, powder or liquid form. The storage member in this embodiment is a generally cup-like member, with a generally cylindrical sidewall portion 82 and a web portion 84 having an opening 86 formed therein. The storage member 80 may be fabricated of a semi-transparent or transparent plastic material such as, by way of example only, styrene, and is configured for attachment to the cap member by snap fit, adhesive, welding or other connection method. For example, the cap 60 top web surface may have a peripheral ridge with groove extending above the web portion 64, which may be engaged in a snap fit by an inwardly extending corresponding feature on the bottom of the wall portion 82.

The dispensing cap system 50 further includes a shuttle valve member 90 having a hollow generally cylindrical wall portion 92, and a top web portion 94 at one end thereof which extends across the end of the wall portion. A bottom flange 92B is formed at the distal end of the wall portion, and has an outer diameter larger than the diameter of the opening in the storage member 80. A tip 96 of reduced diameter relative to the wall portion 92 extends above the surface of the web portion 94. The sidewall of the tip has several ports 96A formed therein, and permit the beverage to pass through from the bottle when the valve is in an open position. The diameter of the wall portion 92 is sized in cooperation with the diameter of the opening 86 in the storage member, so that the cylindrical wall portion tightly fits within the opening in a sliding or even interference fit.

A nipple member 100 is sized to fit over the shuttle valve. The shuttle valve has a range of sliding movement within the storage member, and the nipple has a range of sliding movement on the shuttle valve, such that, when the nipple is in a closed position as in FIG. 2, the ports 96A are sealed by the nipple. In an open position as in FIG. 3, the nipple does not cover the ports 96A, allowing liquid to pass through from the bottle, so the user can drink the beverage.

Figure 2:
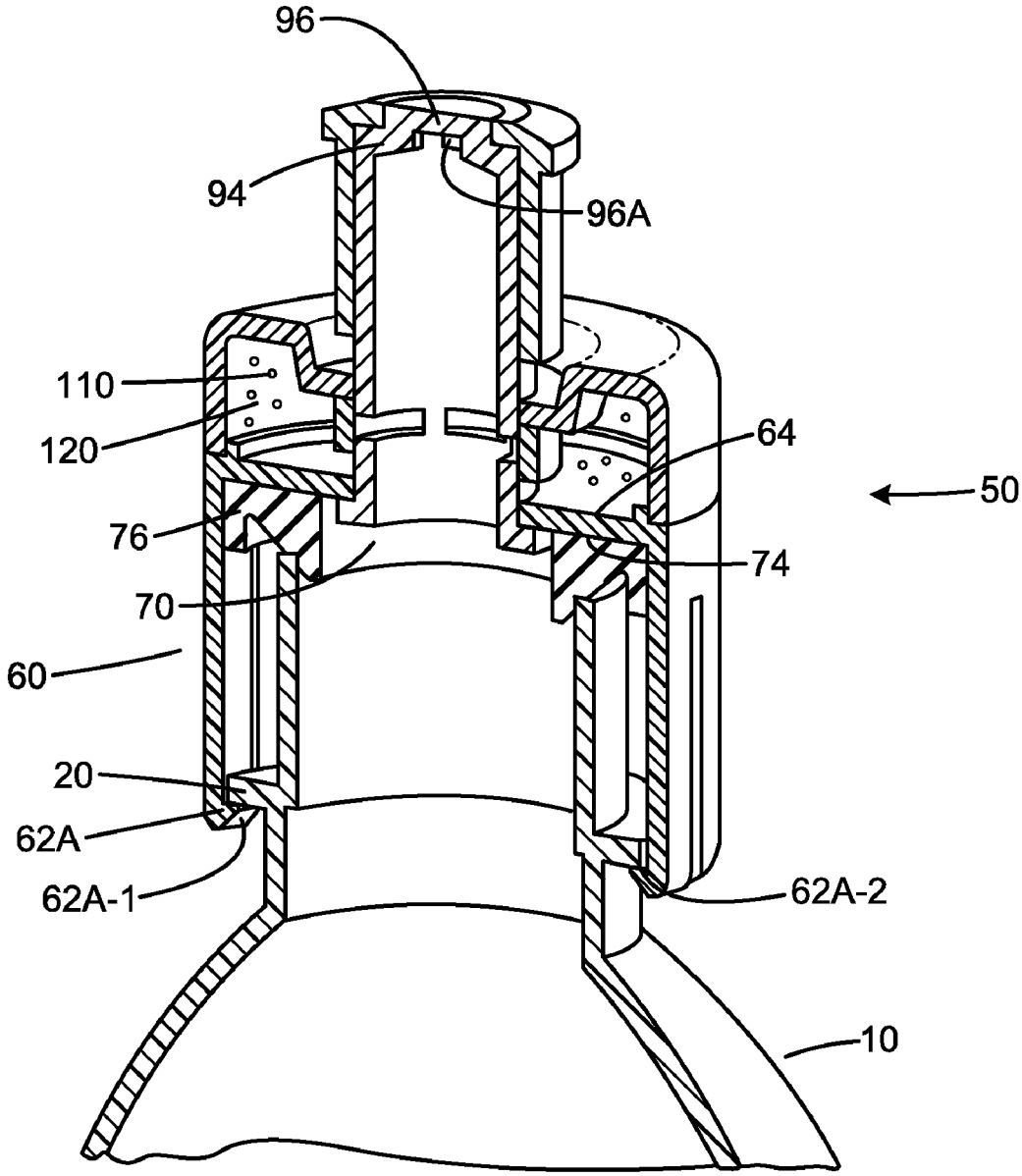
FIG. 2 is a cutaway view of an exemplary dispensing cap system as installed on a bottle, with the system in a filled state.

FIG. 2 is a cutaway view of the dispensing cap system 50 as installed on a bottle 10, with the system 50 in a filled state as delivered to the user. In this state, the valve 90 is positioned so that the lower flange 92B is in contact with the lower surface of the web portion 64 of the cap member, and the nipple is in a closed position relative to the nipple. The interior volume 110 of the storage member 80 has been filled with a quantity of supplement material 120. The openings 92A in the nipple are blocked by the solid wall portion of the boss 66, preventing the supplement material from passing through the openings 92A.

Still referring to FIG. 2, the system 50 is installed on the bottle 10, with the barbed tips 62A of the finger portions 62 having been pushed over the bottle flange 20, with the angled surfaces 62A-1 facilitating the installation by transferring a flexing force tending to splay the tips 62A outwardly as user pushes the cap system 50 downwardly over the neck of the bottle and the surfaces 62A-1 contact the flange edge. Continued downward pressure on the cap system results in the seal 70 coming into contact with the top lip of the neck and compressing somewhat to seal against the top lip of the opening. The barbed tips 62 then pass over the flange and lock the cap system in place by engagement of the horizontal surfaces 62A-2 with the underside of the flange.

The seal member 70 includes a center opening 72 through which the bottle contents may pass, and a generally flat upper surface 74. The outer periphery of the seal includes a downwardly extending peripheral wall 76. The lower surface of the seal defines a tapered surface 78 defining a partial conical seal surface which may be contacted by the bottle neck lip when the cap system is attached to the bottle neck. The conical seal surface has sufficient with relative to the bottle opening to seal a range of neck sizes, and also provide some adjustment to differences in the distance between the bottle neck flange and the top of the neck.

Figure 3:
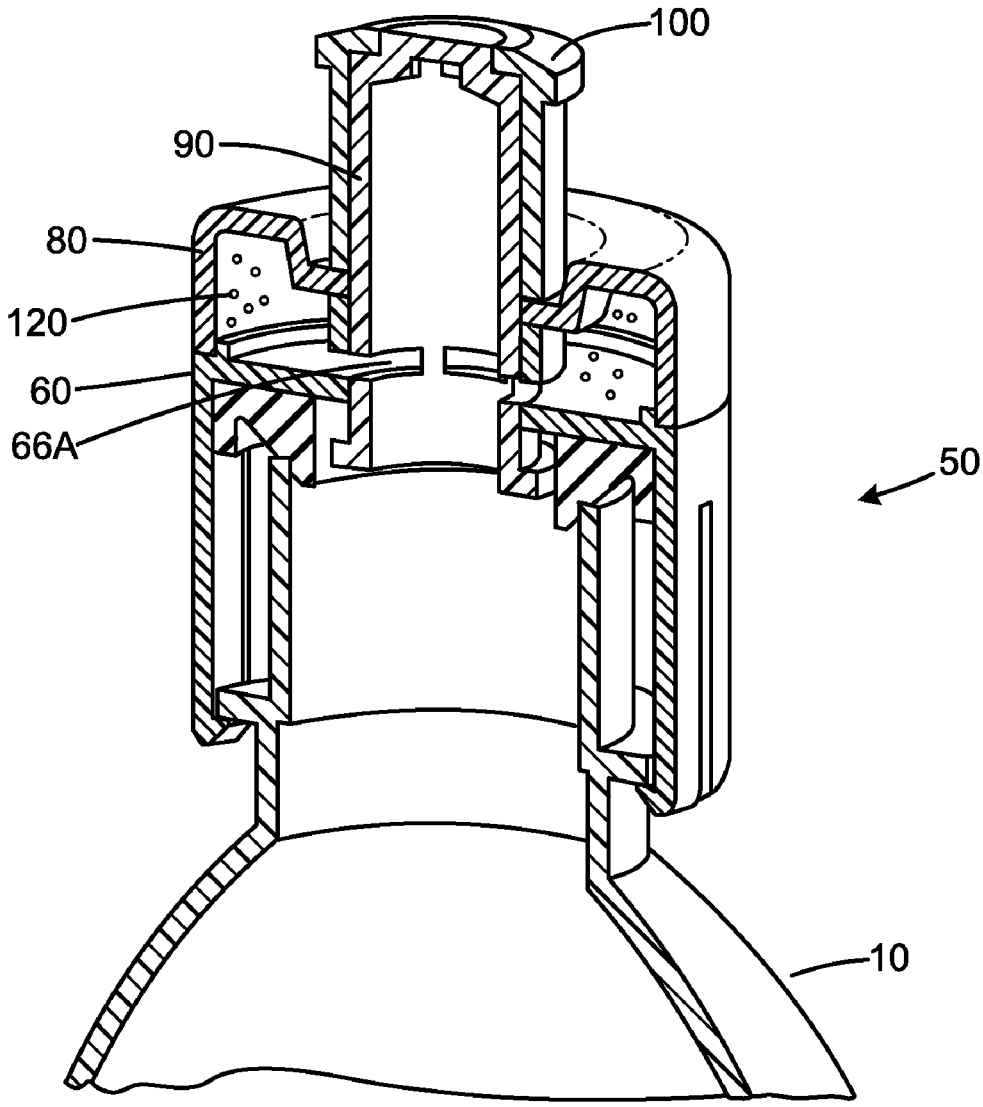
FIG. 3 is a cutaway view similar to FIG. 2, but with the shuttle valve in a dispensing state or position.

FIG. 3 is a cutaway view similar to FIG. 2, but with the shuttle valve 90 pushed downwardly, with the bottom end of the nipple 100 contacting the surface of the storage member 80. In the position or dispensing state shown in FIG. 3, the ports 92A in the valve member are at least partially aligned with the slot openings 66A formed in the cap member boss 66. The supplement material 120 is dispensed through the aligned openings and ports, and into the liquid in the bottle 10. The nipple 100 is still in a closed position relative to the valve 90, so that the contents of the bottle cannot be drawn through the valve 90. Depending on the tightness of the fit between the storage member and the valve, the user may tap the nipple and valve to cause the movement between the closed state shown in FIG. 2 and the dispensing state shown in FIG. 3. With the cap system in the dispensing state as in FIG. 3, the user may shake the bottle and assembled cap system to ensure full dispensing of the supplement material from the storage member into the bottle, and facilitate dissolving or mixing of the supplement with the bottle contents.

Figure 4:
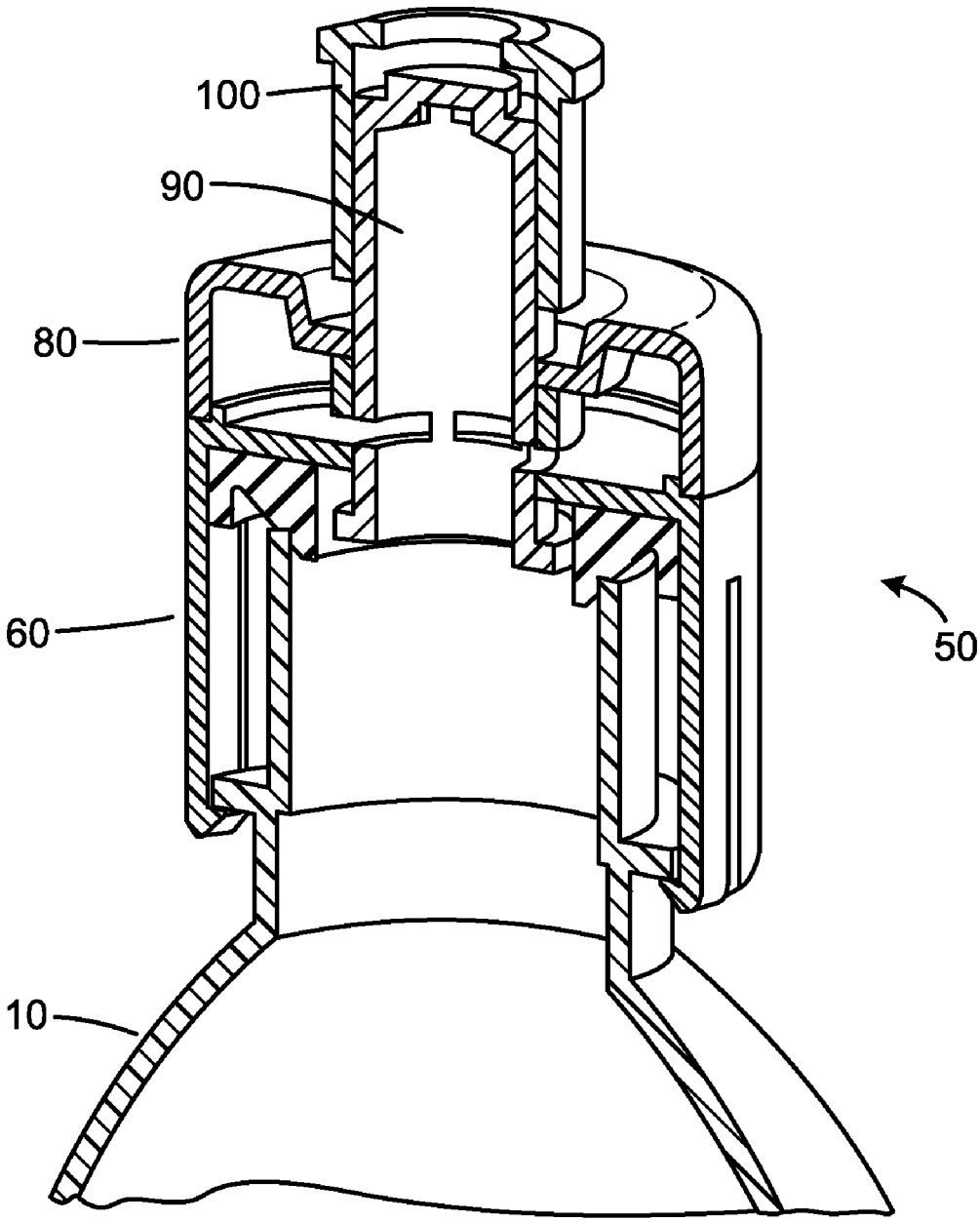
FIG. 4 is a cutaway view similar to FIG. 3, but with the cap nipple pulled up and in an open state relative to the valve member.

FIG. 4 is a cutaway view similar to FIG. 3, but with the nipple 100 pulled up and in an open state relative to the valve 90. In this position, the ports 96 on the tip of the valve are exposed, and provide ports through with the user may drink the bottle contents. In FIG. 4, the valve 90 has remained in the dispensing position relative to the storage member 80. The valve may be fitted with a projecting feature that allows the valve to be pushed from the storage position to the dispensing position, but due to engagement with the bottom of the cap member 60 is prevented from being pulled back to the storage position. Alternatively, the valve member 90 may be raised to the storage position as the nipple is opened.

Figure 5:
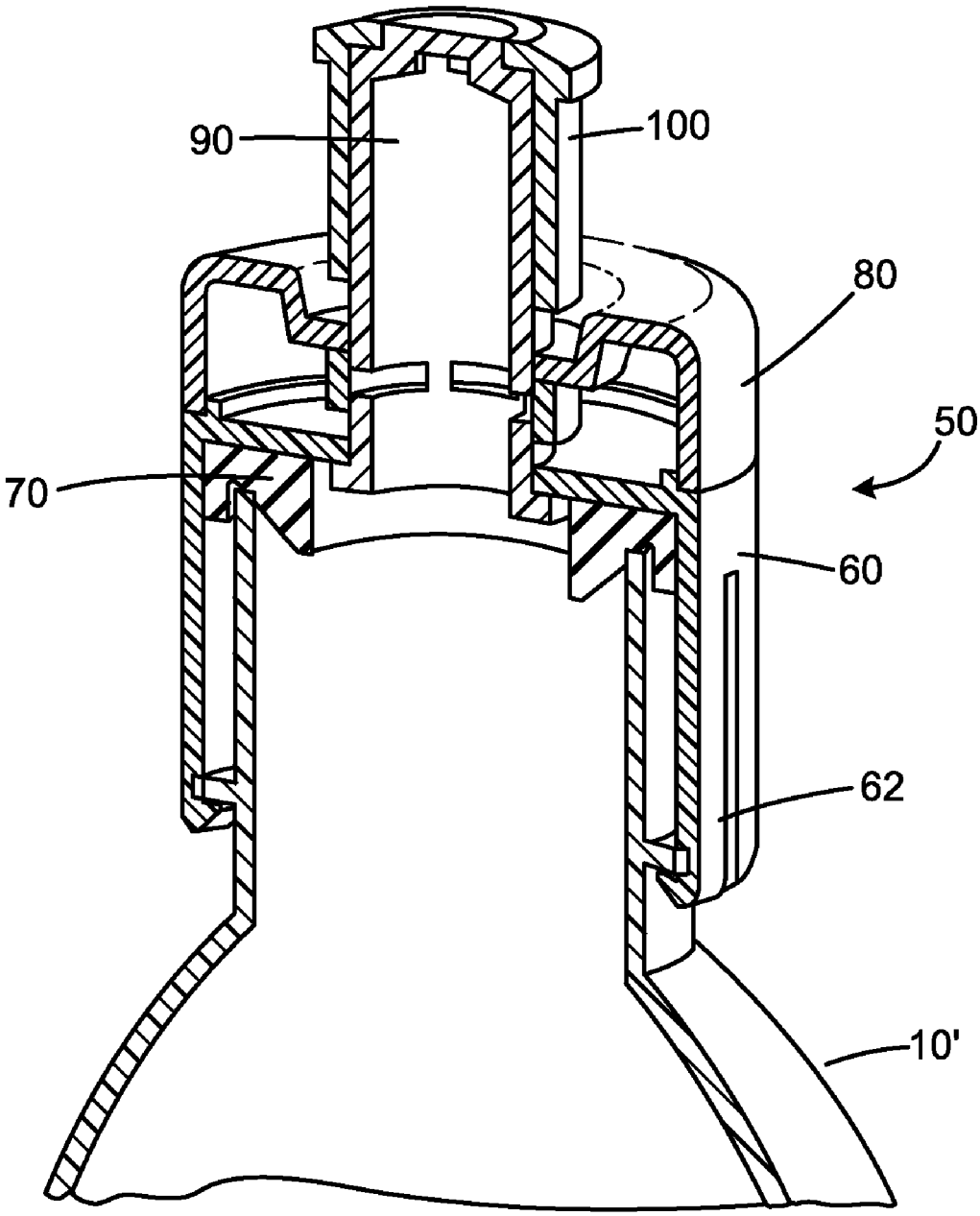
FIG. 5 is a cutaway view of a bottle of a large neck opening size in relation to the bottle shown in FIG. 2, with an exemplary embodiment of the cap system installed on the bottle neck.

FIG. 5 is a cutaway view of a bottle 10' with an exemplary embodiment of the cap system 50 installed on the bottle neck. The bottle 10' has a somewhat large neck diameter than that of the bottle 10, and yet the same cap system is configured to seal and install on the bottle neck. This is due to the use of an expandable attach system as provided by the finger portions 62 of the cap member, and the seal 70 with its seal surface broad enough to seal against necks of different sizes. In an exemplary embodiment the seal surface provided by the seal member 70 is conical, which can increase the seal pressure for larger diameter bottle neck openings, and/or accommodate differences in the distance between the top of the neck and the neck flange for different bottle types. Thus, instead of utilizing a threaded connection between the cap system and the bottle neck, a connection which accommodates different neck sizes is employed.

An exemplary embodiment of a bottle cap dispensing system may accommodate bottle necks of different dimensions, so that one cap dispensing system can be used with several bottle sizes, e.g. with different neck heights (flange to neck opening), and various bottle neck opening diameters. Exemplary ranges are from 5 mm to 25 mm (neck height range) and 18 mm to 30 mm (diameter range of bottle neck openings). A typical diameter range is from 26.5 mm to 28 mm.

Figure 6:
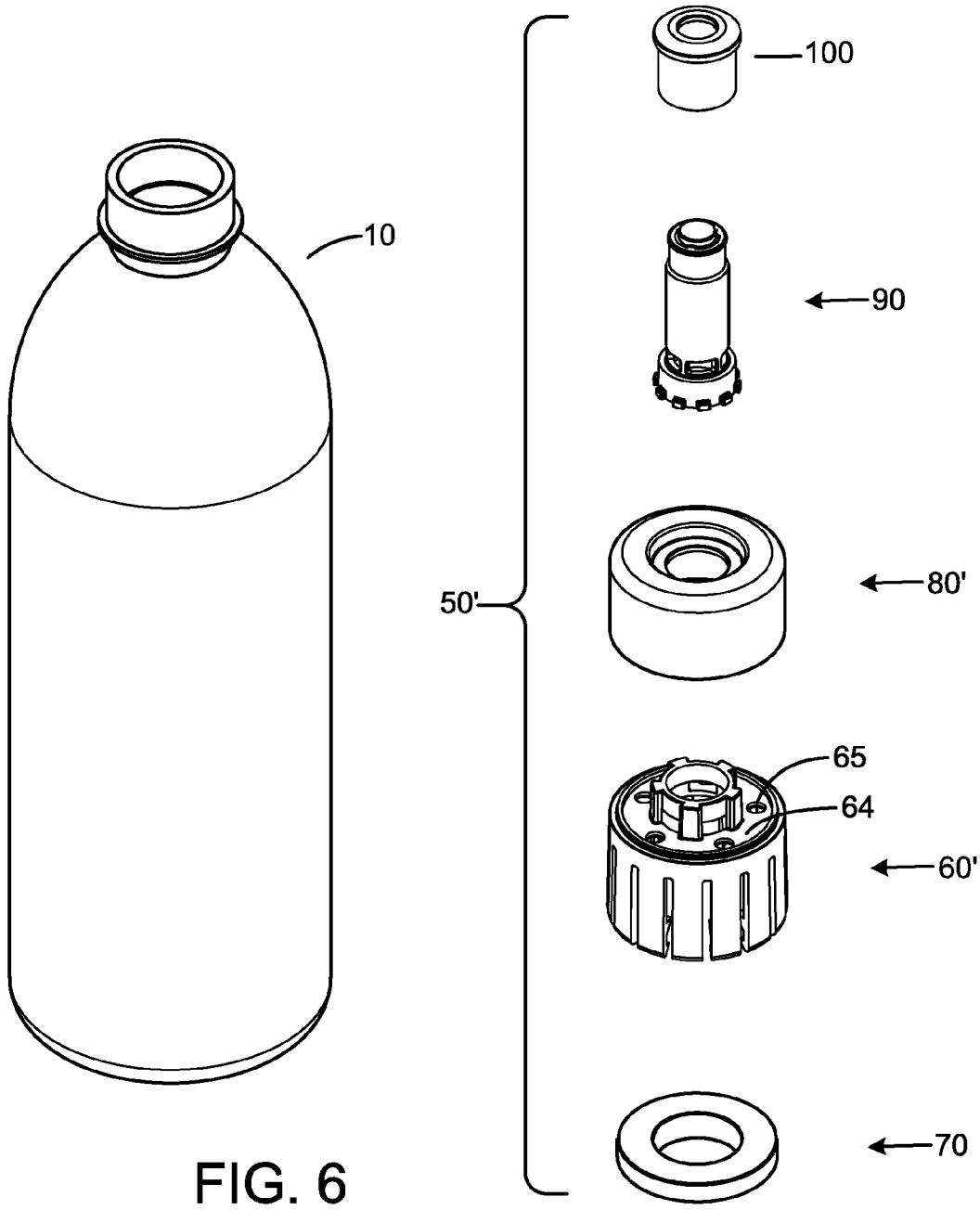
FIG. 6 is an exploded view of an alternate embodiment of a dispensing cap bottle cap dispensing system.

An alternate embodiment of a dispensing cap system 50' is illustrated in FIG. 6. The alternate embodiment is similar to the embodiment illustrated in FIGS. 1A-5. However, the cap member 60' has a plurality of fill openings 65 formed in the web surface 64. The fill openings provide a means to allow the product to be dispensed to be filled into the supplement storage member 80' after it has been attached or assembled to the cap member 60'. A liquid or powder supplement material can be loaded into the storage member through the fill openings, e.g. by pouring the supplement into the openings with the cap/storage member assembly in an inverted position. After the storage member 80' has received the supplement load, the bottle seal member 70 is inserted into the cap and pushed against the bottom of the web surface to seal the fill openings. The capacity of the storage container 80' is increased in relation to that of storage container 80 (FIGS. 1-5) by increasing the depth dimension in this exemplary embodiment.

Figure 7:
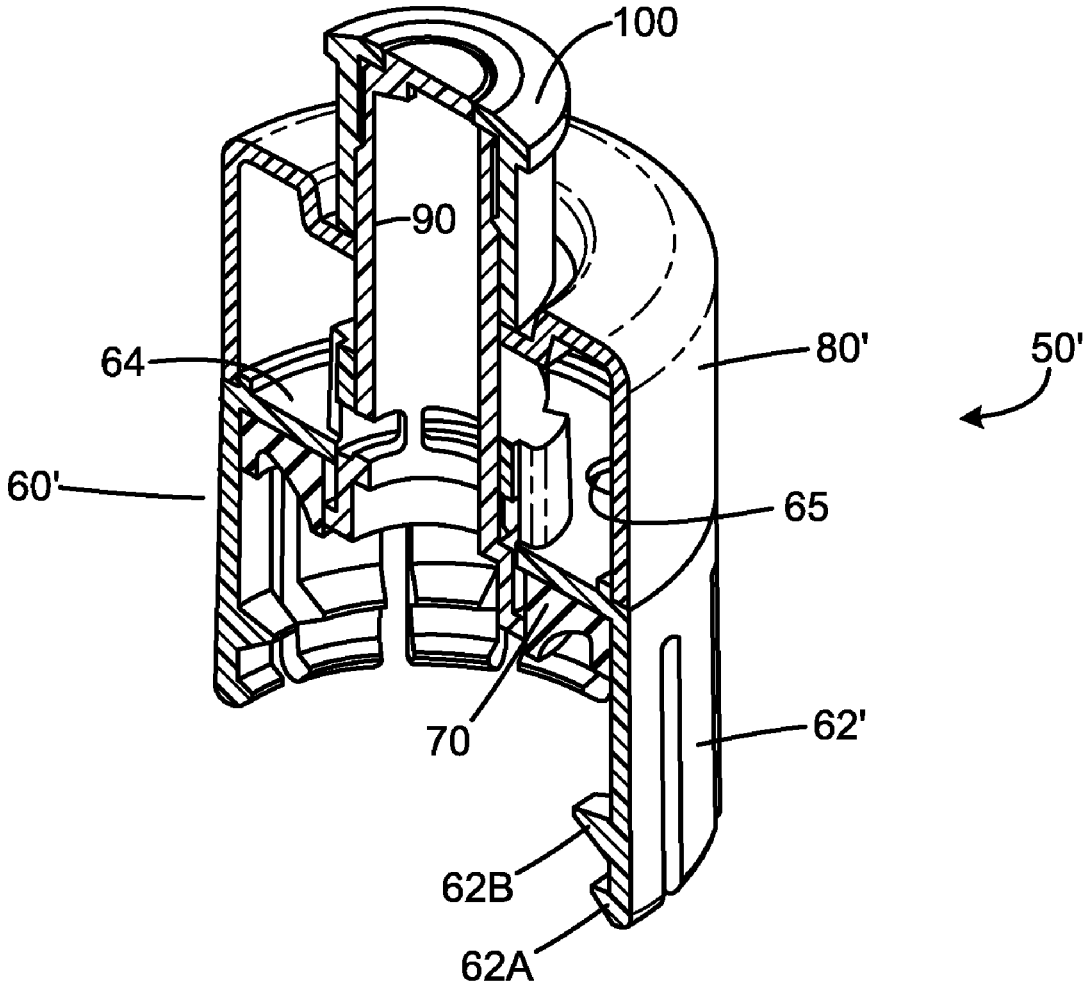
FIG. 7 is a cutaway view of the alternate embodiment of FIG. 6 in an assembled condition.

The embodiment 50' of FIG. 6 is further illustrated in the assembled, cut-away view of FIG. 7. Here the seal member 70 is shown in the seal position, closing off the file openings 65 formed in the cap member surface 64.

FIG. 7 illustrates another feature of the bottle cap assembly 50'. Since some bottles have different neck-flange-to-neck-top-surface dimensions, at least some of the finger portions 62 of the cap member 60' are formed with two sets of barb portions, the barb tip 62A and an intermediate barb portion 62B. In the disclosed embodiment, each of the finger portions is formed with the barb tip portion and the intermediate barb portion. In other embodiments, fewer than all the finger portions may be fabricated with both, one, or none of the barb portions. Moreover, in other embodiments, some of the finger portions may have only a tip barb portion, and others may have only an intermediate barb portion.

Use of the intermediate barb portions 62B with the tip barb portions 62A enables the bottle cap assembly 50' to accommodate even more variations in the bottle neck. For bottle necks with relatively smaller distances from the bottle opening surface against which the bottle cap assembly will seal to the bottle neck flange, the intermediate barb portions 62B may engage the flange to hold the cap assembly in place. For other bottle necks with relatively larger flange distances, the barb tip portions may engage the flange to hold the cap assembly in place.

Figure 8:
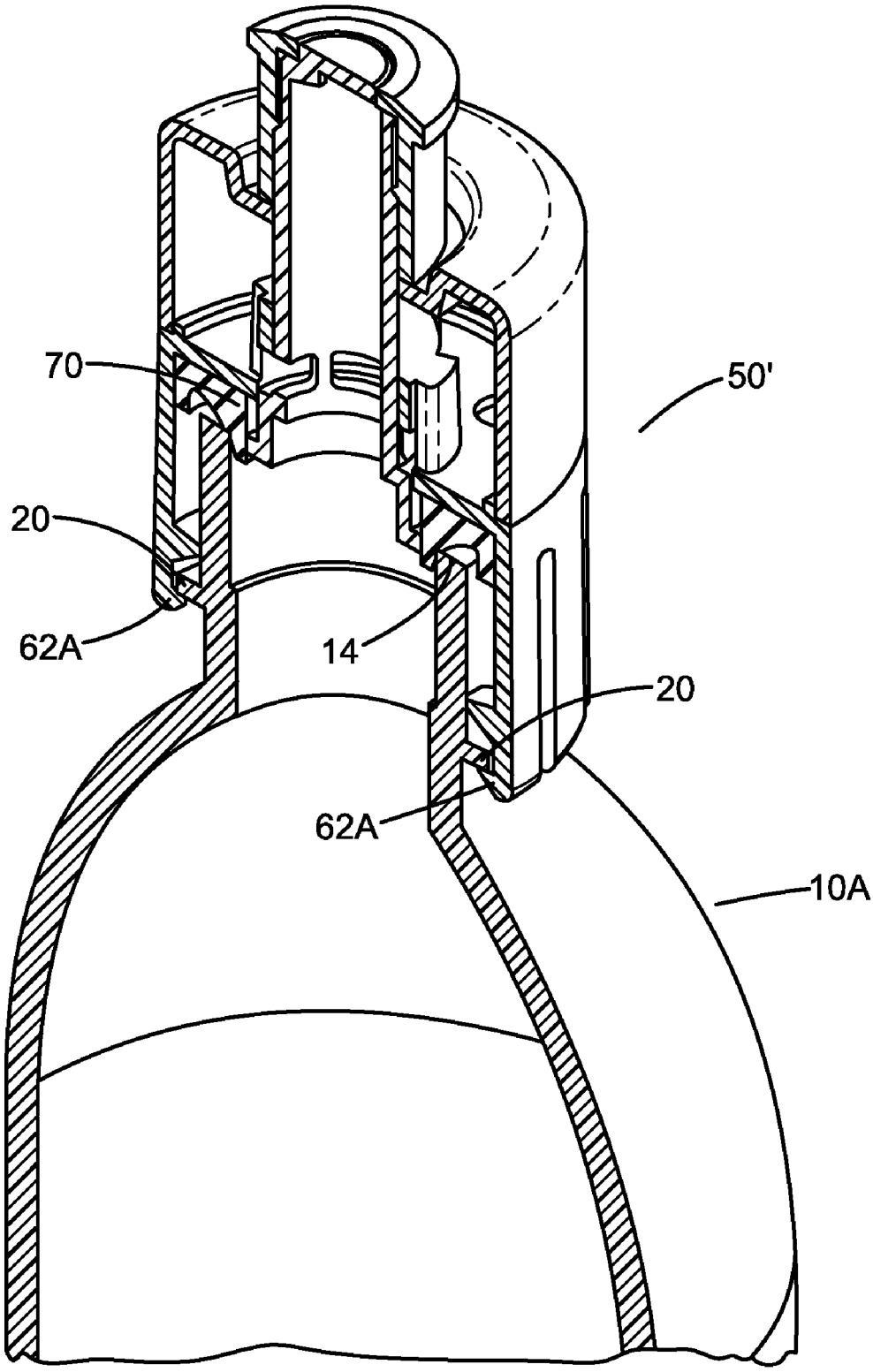
FIGS. 8, 9 and 10 are cutaway views of the alternate embodiment of FIG. 6, shown in an engaged position on three exemplary bottle types.
Figure 9:
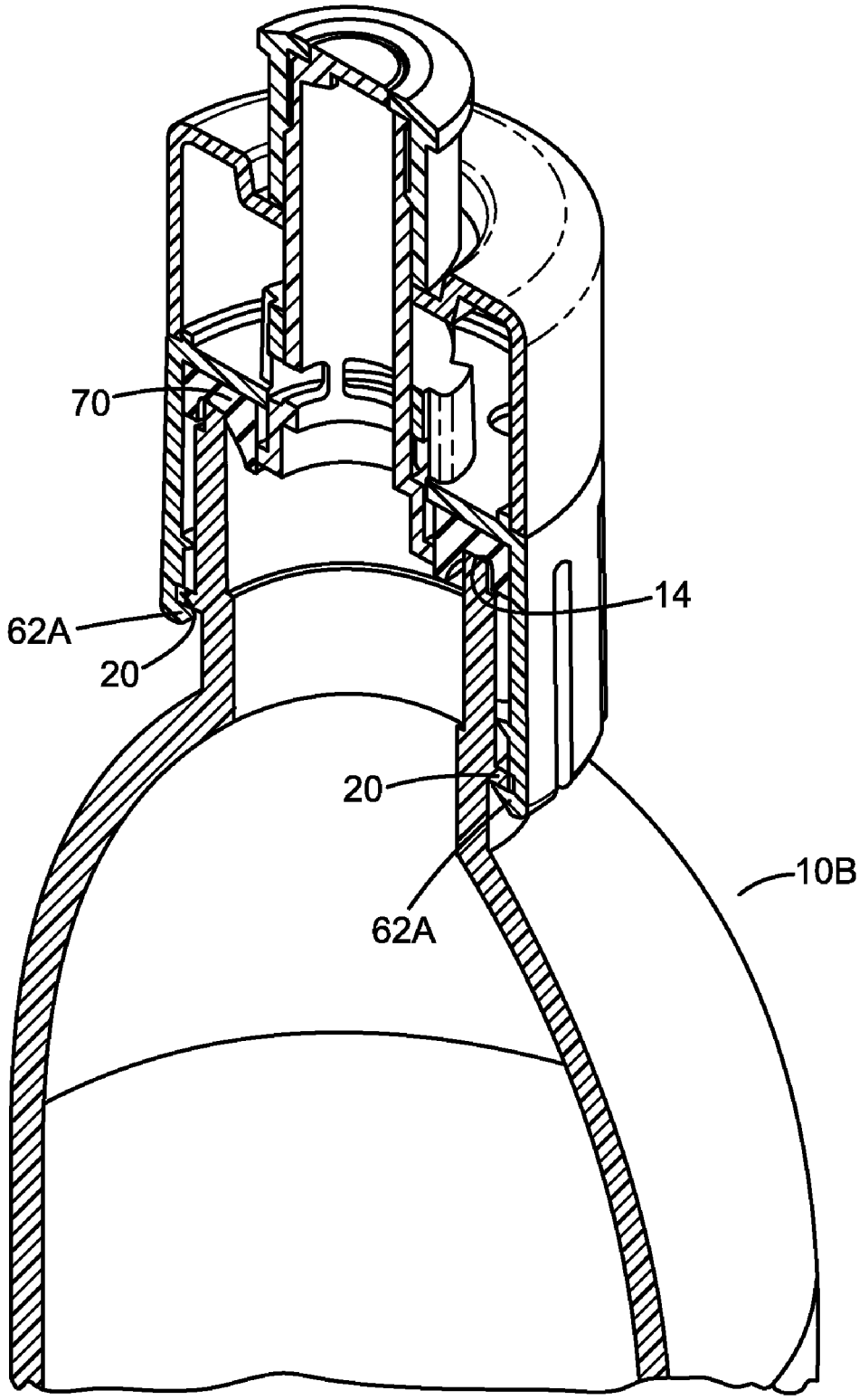
Figure 10:
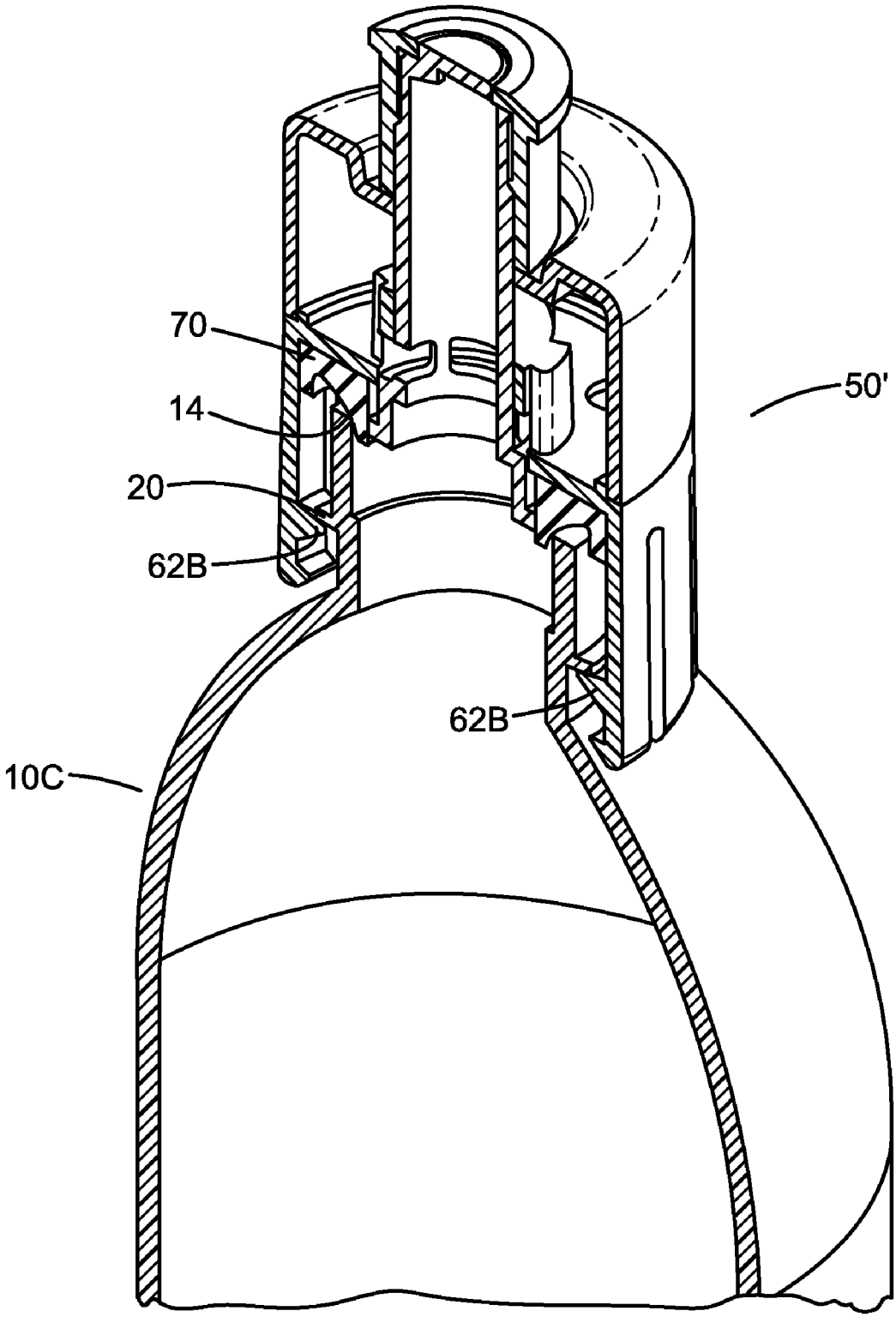

The versatility of the bottle cap assembly 50' in accommodating bottle necks of different neck opening sizes and flange dimensions is illustrated in the cutaway views of FIGS. 8, 9 and 10. Here, the bottle 10A has a relatively longer distance between the flange 20 and the neck opening surface 14. The bottle cap assembly is secured to the bottle by engagement of the tip barb portions with the flange 20. The neck opening of the bottle also has a relatively smaller diameter, with the surface 14 engaging the seal closer to the inward edge of the seal.

FIG. 9 shows the cap assembly 50' in sealed position on the neck of another bottle 10B, this bottle having a somewhat larger neck opening diameter than that of bottle 10A, so that the neck surface 14 engages the seal surface of the seal member 70 in a position further away from the center of the seal member. However, the distance from the neck opening to the flange 20 is still relatively large, and the tip barb portions 62A are engaging the flange to hold the assembly 50' in sealed position to the bottle neck.

FIG. 10 shows the cap assembly 50' in sealed position on the neck of yet another bottle 10C, this bottle, having a somewhat smaller neck opening diameter than that of bottle 10C, so that the neck surface 14 engages the seal surface of the seal member 70 in a position closer to the center of the seal member. However, the distance from the neck opening to the flange 20 is relatively smaller than that of bottles 10A and 10B, and the intermediate barb portions 62B are engaging the flange to hold the assembly 50' in sealed position to the bottle neck.

In the embodiment 50', the cap member is provided with two barb positions relative to the bottle neck opening 14, i.e. the barb position of tip portion 62A and the barb position of intermediate barb portion 62B. In other embodiments, more than two barb portions positions may be provided, either on each finger portions or at staggered finger portions. This may provide a single bottle cap assembly configuration to accommodate more than two or three different bottle sizes. The bottle sizes are typically determined by a drink manufacturer, say a bottled water purveyor, sports drink purveyor or other drink vendor. Providing flexibility in the dispensing cap assembly to accommodate multiple bottle types provides the advantage of reducing the number of different types of dispensing cap assemblies needed to fit to the multiple bottle types.

Although the foregoing has been a description and illustration of specific embodiments of the subject matter, various modifications and changes thereto can be made by persons skilled in the art without departing from the scope and spirit of the invention.

What is claimed is:

1. A dispensing cap system for dispensing a supplement material through a bottle neck opening and into the bottle, comprising:

a cap member including a connection structure for non-threading engagement with the bottle neck, the cap member including a web portion having an opening formed therein and a boss structure extending around the opening and having one or more dispensing ports defined therethrough;

a seal member having a seal surface arranged for sealing contact with the bottle neck, the seal surface having a lateral extent sufficient to provide sealing contact with bottle necks of different opening sizes;

a storage member assembled to the cap member and including an outer wall defining an outer periphery of a storage volume for holding the supplement material, the storage member having an opening formed through the outer wall in alignment with the opening in the cap member;

a generally cylindrical valve member including generally cylindrical wall member, with a flange member at a first end and a valve tip having one or more valve ports at the tip and one or more dispensing ports disposed adjacent the first end, the valve member configured for sliding movement within the boss structure and the opening in the storage member between a storage position in which the dispensing ports are blocked by the boss structure and a dispensing position in which the one or more dispensing ports is in alignment with a corresponding boss port to allow the supplement material to pass through from the storage volume;

a valve nipple configured to fit onto the valve for sliding movement between a valve closed position with the valve ports closed by the valve nipple and an open position in which the valve ports are open.

2. The system of claim 1, in which the connection structure comprises a set of finger portions depending downwardly from the web portion, the finger portions including finger barb portions extending inwardly, the cap member formed of a plastic material and the finger portions having sufficient flexibility for the distal ends to splay outwardly to allow the barb portions to pass over a neck flange as the cap member is installed onto the neck, and the barb portions engage the flange to secure the cap member onto the bottle neck.

3. The system of claim 2, wherein the finger barb portions are disposed at the distal ends of the finger portions.

4. The system of claim 2, wherein the finger barb portions include a set of barb portions disposed intermediate the finger portions distal ends and the web portion.

5. The system of claim 2, wherein the finger barb portions include a first set of barb portions located at the distal ends of at least some of said finger portions, and a second set of barb portions located intermediate the distal ends of at least some of said finger portions and the web portion.

6. The system of claim 2, wherein the seal member is fabricated of an elastomeric material, such that the seal surface is compressible to allow sealing engagement with the bottle neck as the finger portions engage the bottle neck flange.

7. The system of claim 1, wherein the seal surface has a generally conical-like shape.

8. The system of claim 1, wherein the web portion of the cap member has at least one fill opening defined therein to allow a quantity of the supplement material to be filled into the storage volume with the seal member not in place, and wherein the seal member includes a web portion contacting surface configured to contact the web portion of the cap member in a seal position relative to the cap member, the contacting surface further configured to close the at least one fill opening when the seal member is disposed in the seal position.

9. The system of claim 1, wherein the cap member is a unitary member fabricated of a plastic material.

10. The system of claim 1, wherein the storage member is fabricated of a transparent or semi-transparent material.

11. The system of claim 1, wherein the valve member in said storage position is at an extended position relative to the web portion of the cap member, and the dispensing position is at a retracted position relative to the web portion.

12. A dispensing cap system for dispensing a supplement material through a bottle neck opening and into the bottle, comprising:

a cap member including a web portion and a connection structure for non-threading engagement with the bottle neck;

a seal member having a seal surface arranged for sealing contact with the bottle neck, the seal surface having a lateral extent sufficient to provide sealing contact with bottle necks of different opening sizes;

a storage member assembled to the cap member and including an outer wall defining an outer periphery of a storage volume for holding the supplement material;

a valve member having one or more valve ports and one or more dispensing ports, the valve member configured for sliding movement between a storage position in which the storage volume is sealed and a dispensing position in which one or more dispensing ports in the cap member are open to allow the supplement material to pass through from the storage volume;

a valve nipple configured to fit onto the valve for sliding movement between a valve closed position and a valve opened position in which contents of the bottle are allowed to pass through the valve member for consumption by a user;

said connection structure comprising a set of finger portions depending downwardly from the web portion, the finger portions having finger barb portions extending inwardly, the cap member having sufficient flexibility for the distal ends to splay outwardly to allow the barb portions to pass over a neck flange as the cap member is installed onto the neck, and the barb portions engage the flange to secure the cap member onto the bottle neck.

13. The system of claim 12, wherein at least some of the finger barb portions are disposed at the distal ends of the finger portions.

14. The system of claim 12, wherein the finger barb portions include a set of barb portions disposed intermediate the finger portions distal ends and the web portion.

15. The system of claim 12, wherein the finger barb portions include a first set of barb portions located at the distal ends of at least some of said finger portions, and a second set of barb portions located intermediate the distal ends of at least some of said finger portions and the web portion.

16. The system of claim 12, wherein the seal member is fabricated of an elastomeric material, such that the seal surface is compressible to allow sealing engagement with the bottle neck as the finger portions engage the bottle neck flange.

17. The system of claim 16, wherein the seal surface has a generally conical-like shape.

18. The system of claim 12, wherein the web portion of the cap member has at least one fill opening defined therein to allow a quantity of the supplement material to be filled into the storage volume with the seal member not in place, and wherein the seal member includes a web portion contacting surface configured to contact the web portion of the cap member in a seal position relative to the cap member, the contacting surface further configured to close the at least one fill opening when the seal member is disposed in the seal position.

19. The system of claim 12, wherein the barb portions each includes a tapered lower surface and a generally flat or horizontal surface transverse to the finger portion, the tapered lower surfaces facilitating installation of the cap system onto a bottle neck by transferring a flexing force tending to splay the finger portion tips outwardly as the cap system is pushed downwardly over the bottle neck and the tapered lower surfaces contact a bottle flange edge, and continued downward pressure on the cap system resulting in the seal coming into contact with a top lip of the neck and sealing against the top lip, the barbed tip portion configured to pass over the flange and lock the cap system in place by engagement of the horizontal surfaces of the barb portions with an underside of the flange.

20. A dispensing cap system for dispensing a supplement material through a bottle neck opening and into the bottle, comprising:

a cap member including a connection structure for non-threading engagement with the bottle neck, the cap member including a web portion having an opening formed therein and a boss structure extending around the opening and having one or more dispensing ports defined therethrough;

a seal member having a seal surface arranged for sealing contact with the bottle neck;

a storage member assembled to the cap member and including an outer wall defining an outer periphery of a storage volume for holding the supplement material, the storage member having an opening formed through the outer wall in alignment with the opening in the cap member;

a generally cylindrical valve member including generally cylindrical wall member, with a flange member at a first end and a valve tip having one or more valve ports at the tip and one or more dispensing ports disposed adjacent the first end, the valve member configured for sliding movement within the boss structure and the opening in the storage member between a storage position in which the dispensing ports are blocked by the boss structure and a dispensing position in which the one or more dispensing ports is in alignment with a corresponding boss port to allow the supplement material to pass through from the storage volume;

a valve nipple configured to fit onto the valve for sliding movement between a valve closed position with the valve ports closed by the valve nipple to prevent contents of the bottle from passing through the valve member and an open position in which the valve ports are open to allow contents of the bottle to pass through the valve member for utilization or consumption by a user.

21. A dispensing cap system for dispensing a supplement material into a beverage bottle through a bottle neck opening, the bottle neck having a flange protruding from a peripheral portion of the bottle neck, the cap system comprising:

a cap member including a connection structure for engagement with a bottle flange to secure the cap member in place on the bottle neck, the cap member including a web portion having an opening formed therein and a boss structure extending around the opening and having one or more dispensing ports defined therethrough;

a seal member having a seal surface arranged for sealing contact with the bottle neck;

a storage member assembled to the cap member and including an outer wall defining an outer periphery of a storage volume for holding the supplement material, the storage member having an opening formed through the outer wall in alignment with the opening in the cap member;

a generally cylindrical valve member including generally cylindrical wall member, with a flange member at a first end and a valve tip having one or more valve ports at the tip and one or more dispensing ports disposed adjacent the first end, the valve member configured for sliding movement within the boss structure and the opening in the storage member between a storage position in which the dispensing ports are blocked by the boss structure and a dispensing position in which the one or more dispensing ports is in alignment with a corresponding boss port to allow the supplement material to pass through from the storage volume;

a valve nipple configured to fit onto the valve for sliding movement between a valve closed position with the valve ports closed by the valve nipple to prevent contents of the bottle from passing through the valve member and an open position in which the valve ports are open to allow contents of the bottle to pass through the valve member for utilization or consumption by a user.

22. A dispensing cap system for dispensing a supplement material into a beverage bottle through a bottle neck opening, the bottle neck having a flange protruding from a peripheral portion of the bottle neck, the cap system comprising:

a cap member including a connection structure for engagement with a feature of the bottle neck and secure the cap member to the bottle neck, the connection structure configured to secure the cap member to a plurality of bottles with bottle necks of different dimensions;

a seal member in contact with the cap member and having a seal surface arranged for sealing contact with the bottle neck and configured for sealing contact with a plurality of bottles of different neck opening sizes;

a storage member assembled to the cap member and including an wall defining an outer periphery of a storage volume for holding the supplement material;

a valve member cooperatively engaged with the cap member and the storage member, the valve member configured for sliding movement between a storage position in which the storage volume is sealed to prevent the supplement materials from dispensing into the bottle through the neck opening and a dispensing position in which the supplement material to pass into the bottle from the storage volume;

a valve nipple configured to fit onto the valve for sliding movement between a valve nipple closed position to prevent contents of the bottle from passing through the valve member and an open position configured with the valve member to allow contents of the bottle to pass through the valve member for utilization or consumption by a user.

23. The system of claim 22, wherein the bottle neck feature comprises a bottle neck flange.

24. The system of claim 23, wherein said connection structure comprises a set of finger portions disposed around a cap member periphery and having finger barb portions, the finger portions having sufficient flexibility for distal ends to splay outwardly to allow the barb portions to pass over a neck flange as the cap member is installed onto the neck, and the barb portions engage the flange to secure the cap member onto the bottle neck.

* * * * *